US005095550A

United States Patent [19]

Perlinger

[11] Patent Number: 5,095,550

[45] Date of Patent: Mar. 17, 1992

[54] HELMET CLOSURE

[76] Inventor: Jon A. Perlinger, 402 S. Morgan, Minneapolis, Minn. 55402

[21] Appl. No.: 596,052

[22] Filed: Oct. 11, 1990

Related U.S. Application Data

[63] Continuation-in-part of Ser. No. 429,022, Oct. 30, 1989, abandoned.

[51] Int. Cl.[5] ..... A42B 1/24

[52] U.S. Cl. ..... 2/422; 2/410

[58] Field of Search ..... 2/205, 417, 421, 422, 2/410, 425, 424

[56] References Cited

U.S. PATENT DOCUMENTS

| | | | |
|---|---|---|---|
| 3,039,108 | 6/1962 | Lohrenz | 2/421 |
| 3,205,508 | 9/1965 | Cox | 2/410 |
| 3,825,952 | 7/1974 | Pershing et al. | 2/422 |
| 4,017,906 | 4/1977 | Bochynsky et al. | 2/205 |
| 4,091,469 | 5/1978 | Davidson | 2/410 |
| 4,424,880 | 1/1984 | Murayama et al. | 2/422 |
| 4,573,222 | 3/1986 | Zago | 2/424 |
| 4,598,430 | 7/1986 | Nava | 2/410 |
| 4,697,289 | 10/1987 | Luigi | 2/422 |
| 4,887,319 | 12/1989 | Daniels | 2/410 |

FOREIGN PATENT DOCUMENTS

| | | | |
|---|---|---|---|
| 197806 | 6/1978 | Fed. Rep. of Germany | 2/424 |
| 2853484 | 6/1980 | Fed. Rep. of Germany | 2/421 |
| 2921353 | 12/1980 | Fed. Rep. of Germany | 2/424 |
| 2496422 | 6/1982 | France | 2/425 |
| 2595573 | 9/1987 | France | 2/424 |
| 1526574 | 9/1978 | United Kingdom | 2/424 |

*Primary Examiner*—Werner H. Schroeder
*Assistant Examiner*—Michael A. Neas
*Attorney, Agent, or Firm*—Clayton R. Johnson

[57] ABSTRACT

A closure made of wind resistant material for motorcycle helmets. One embodiment of the closure has a front flap (20) which opens to allow the head to pass through the closure into the helmet. The front flap closes with hook and loop or other fasteners. The rear of the closure has an elastic panel (12) to allow stretching as the helmet passes over the head. An elasticized neck ribbing (14) closes around the wearer's neck. The closure attaches to the helmet by means of squeezing the outer (upper) edge of the closure between the helmet padding and helmet shell, as well as with hook and loop fasteners. In a second embodiment the closure has a continuous panel having front edge portions with one of hook and loop fasteners for removably securing the front edge portions to one another. A third embodiment has longitudinally extending straps for mounting the closure to the helmet.

22 Claims, 8 Drawing Sheets

HELMET CLOSURE

CROSS REFERENCE TO RELATED APPLICATION

This application is a continuation-in-part of my application Ser. No. 07/429,022, filed Oct. 30, 1989, now abandoned.

BACKGROUND OF THE INVENTION

This invention relates to protective integral motorcycle helmets, specifically to a means for sealing the opening that the wearer's head fits through to put the helmet on.

DESCRIPTION OF PRIOR ART

This discussion relates primarily to motorcycle helmets, but can apply to other helmets as is discussed later. Heretofore integral helmet makers have not generally provided a means to seal the opening through which the head fits. This unsealed opening has several disadvantages. Wind created by passing through the air while riding a motorcycle, for example, enters the helmet opening and creates a noise which increases with motorcycle speed and side wind velocity. Bugs, road debris, sand and dust and other objects enter the opening at inopportune times creating safety hazards. Air enters during cool weather riding making the rider cold. The entering air also causes the helmet to lift on the users head. Excessive noise prevents hearing speakers placed in the helmet as part of a stereo or intercom system. Rain or snow enters the unsealed opening.

The BMW Company of Germany has designed a two-piece means of sealing the head opening on their own hinged integral helmet. This method will work only on the hinged integral helmets made by BMW. The hinge provides the opening/closing method.

Bell Helmets, Inc. has designed a partial closure to fit Bell helmets. Their closure is made of terry cloth which allows wind to pass through it. The closure only covers that portion of the opening in front of the user's neck. It does nothing to close the sides or rear of the head opening. Most air entering a helmet does so to the rear and sides of the opening. The partial closure does not have a means for sealing around the neck. It does very little to decrease wind noise. It has little effect, if any, on ability to hear intercom or stereo speakers. Helmet lift reduction is minimal, if existent. Cool air is not sealed out. Bugs, road debris, sand, dust, rain and snow can easily enter the opening when using this partial closure.

U.S. Pat. No. 4,697,289 to Luigi discloses a protective device for a helmet that includes a protective screen with fastener members at the upper latitudinal edge for attachment to the helmet to encircle the neck, two embodiments having longitudinal strip fasteners on opposite ends of the screen. The screen appears to hang nearly straight down from the lower edge of the helmet and not extend under the chin.

British patent 197,809 to Nobl discloses an attachment part that extends partially around the front part of the face and neck of the wearer to adjacent to the ears.

U.S. Pat. No. 4,59B,430 granted to Nava July 8, 1986, and U.S. Pat. No. 4,573, 222 granted to Zago Mar. 4, 1986 include a limited seal design, but cover primarily retention devices.

OBJECTS AND ADVANTAGES

Objects and advantages of the present invention are (a) to provide a closure which reduces wind noise by preventing the rushing air from entering the helmet opening;

(b) to provide a closure which reduces turbulence at the base of the helmet, thus further reducing wind noise and head movement caused by rushing turbulent air;

(c) to provide a closure which enhances the wearer's ability to hear intercom system or stereo system speakers mounted in the helmet;

(d) to provide a closure which prevents bees and other bugs, road debris, sand, dust, rain, snow, and other flying objects from entering the helmet or striking that area of the neck covered by the neck ribbing;

(e) to provide a closure which can be used with a wrap neck band to completely protect the neck from flying objects and elements;

(f) to provide a closure which reduces helmet lift by preventing rushing air from entering the open helmet cavity;

(g) to provide a closure which allows the wearer to have maximum control over a helmet's adjustable ventilation system;

(h) to provide a closure which keeps the wearer's head and neck warm during cool weather riding, thus promoting rider comfort and enjoyment. During warm weather the front flap can be incrementally opened if necessary to keep cool while still having the advantage of side and rear closure of the opening;

(i) to provide a closure which can be made to fit virtually any integral helmet; and (j) to provide a closure which stabilizes the helmet on the wearer's head.

Further objects and advantages of my invention will become apparent from a consideration of the drawings and ensuing description of them.

BRIEF DESCRIPTION OF THE DRAWINGS

Referring to FIGS. 1 and 2, the first embodiment of a typical closure includes a flexible, wind resistant, sheet material 10 forming a layer of each side panel, generally designated 25, having upper and lower latitudinal edges and generally longitudinally extending front and rear edges 25*f* and 25*r* respectively while an elastic panel (rear panel) 12 has opposite generally longitudinally extending edges sewn to the adjacent rear edge 25*r*. The sheet material is at least substantially wind proof, for example tanned leather, vinyl, neoprene with laminated nylon, or other such material. Elastic panel 12 is a thick grade of elastic cut to approximately 6 cm to 10 cm by 6 cm to 10 cm (advantageously 8 cm×8 cm) and is of a one way stretchable material to stretch in a latitudinal direction.

Figure 1:
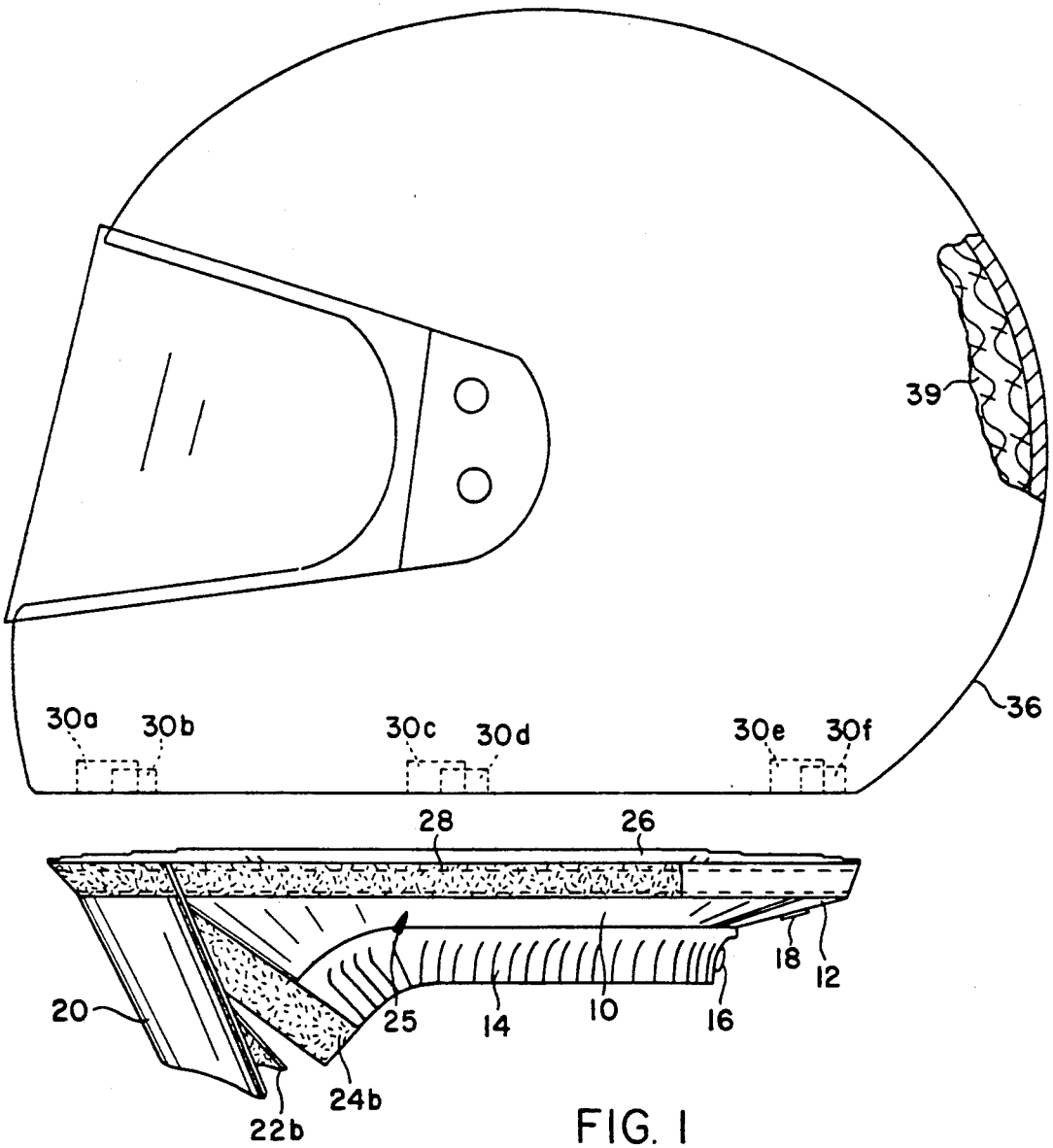
FIG. 1 is a side view of the first embodiment of the helmet closure and helmet shell, a lower portion of one of the fasteners being shown separated from the front flap solely to facilitate the illustration thereof.

Each side panel also includes a layer of lining 32 of a soft, stretchable material that is typically sewn to the side panels 25 while advantageously a sound absorbing material 34 such as open-cell foam is sandwiched between the sheet material and the lining to absorb sound within a conventional helmet 36, 39 that includes the helmet shell 36 and the helmet padding 39.

The longitudinal edge portions of the elastic panel that are sewn to the adjacent longitudinal rear edge portions of the side panel layer 10, absorbing material members 34 and linings 32 and are of a longitudinal dimension less than the longitudinal dimension of the front longitudinal edge portions of members 10, 34, 32. The generally longitudinal dimensions of at least the latitudinal front portions of the side panels generally progressively increase in latitudinal directions toward their front edges. The longitudinal dimension of each of the side panels at a location such indicated by dimension line L in FIG. 2 advantageously is about the same as the corresponding dimension of the helmet padding 39.

Neck ribbing 14 is sewn to the inner edge (top latitudinal edge) of the sheet material and elastic panel. Neck ribbing 14 typically is elasticized ribbing fabric. It can be doubled and can vary in width depending on the extend of the neck covering desired, for example of a width (longitudinal dimension) of 2.5 cm to 8.0 cm, but is typically 4.5 cm wide (longitudinal dimension). A neck ribbing hook fastener 18 is sewn to the longitudinal and latitudinal central portion of the exterior surface of the elastic panel 12 while a neck ribbing loop fastener 16 is sewn to the corresponding exterior portion of the neck ribbing 14. A front flap (front panel) 20 is made of the same material as the sheet material 10. 7- Front strip flap hook and loop fasteners 22*a*, 24*a* and 22*b*, 24*b* are sewn to the adjacent longitudinal edges of the front flap and side panels. Further the lower portions of the loop fasteners 24*a*, 24*b* are sewn to the front longitudinal edge portions of the neck ribbing for the removable attachment to the lower end portions of the hook fasteners 22*a*, 22*b* on the closure flap. The latitudinal spacing of the front edge longitudinal portions of the side panels at the upper latitudinal edge portions thereof is approximately 4 cm to 12 cm, advantageously 6 cm while the corresponding spacing of the lower latitudinal end portions is about 7 cm to 15 cm, advantageously 9 cm.

The longitudinal dimensions of the longitudinal front edges of the front panel advantageously are substantially the same as combined longitudinal dimensions of the front edges of the side panels and the neck ribbing 14. Further the longitudinal edge portions of the front flap overlap the corresponding side flaps edge portions by about 2 cm on each side. The lower peripheral edge of the neck ribbing in a relax (non-stretched condition) preferable is of a dimension that the ribbing would form a close fit with the neck of the wearer, at least when the front flap is in its closed condition wherein the hook and loop fasteners 22*a–b* and 24*a–b* are in their attached relationship.

A somewhat elliptical top latitudinal peripheral mounting strip, generally designated 27, which includes a strip reinforcement 26, is sewn to the entire outer edges of the side panels, elastic panel and front panel, the strip being continuous to extend entirely around the head The strip reinforcement is typically polyethylene about 2 cm wide and about 1 mm thick. Adhesive backed perimeter hook fasteners 30 *a–f* are attached to the lower interior edge portion of the fiberglass or plastic helmet shell 36 after slight displacment of the helmet padding from the shell. The mounting strip 27 also has a perimetric loop fastener strip 28 that is sewn to the exterior perimeter of the strip reinforcement 26 to extend completely therearound for forming a removable attachment to the hook fasteners 30*a–f*. In place of a continuous strip 28, a plurality of arcuately spaced loop fastener units (not shown) may be sewn to the closure strip for forming an attachment fit with the hook fasteners 30*a–f*, there being a fastener unit for each of the hook fasteners 30*a–f*. It is to be understood that in place of a plurality of the hook fasteners 30*a–f*, there may be provided a continuous perimetric strip (not shown) that performs the same function as fasteners 30*a–f*.

Figure 7:
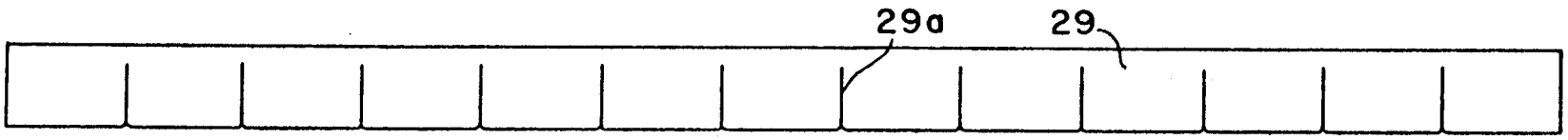
FIG. 7 is a plan view of the expansion strip of the strip reinforcement of the first embodiment in a laid out flat condition.
Figure 8:
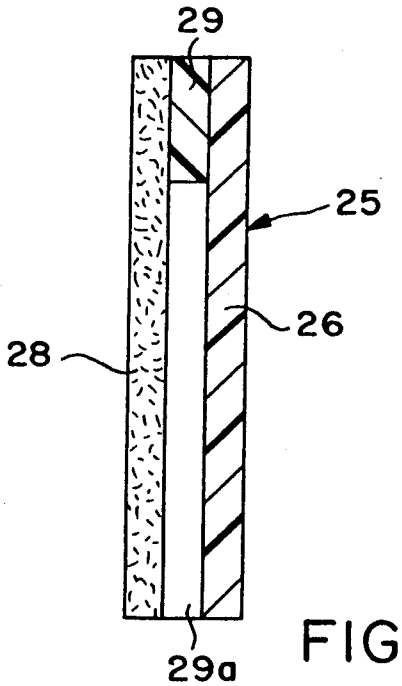
FIG. 8 is a cross sectional view of the mounting strip of the first embodiment, the thickness being exaggerated.

Advantageously the mounting strip includes an expansion strip 29 sewn between the strip reinforcement 26 and the fastener strip 28, strip 29 advantageously being made of the same material as strip reinforcement 26 (see FIGS. 7 and 8) and provides additional reinforcement to strip 26. Latitudinally space slits 29*a* are provided in strip 29 to extend through the top edge of the expansion strip and terminate longitudinally between the upper and lower edges of the expansion strip and much more closely adjacent to the lower edge than the upper edge.

Figure 3:
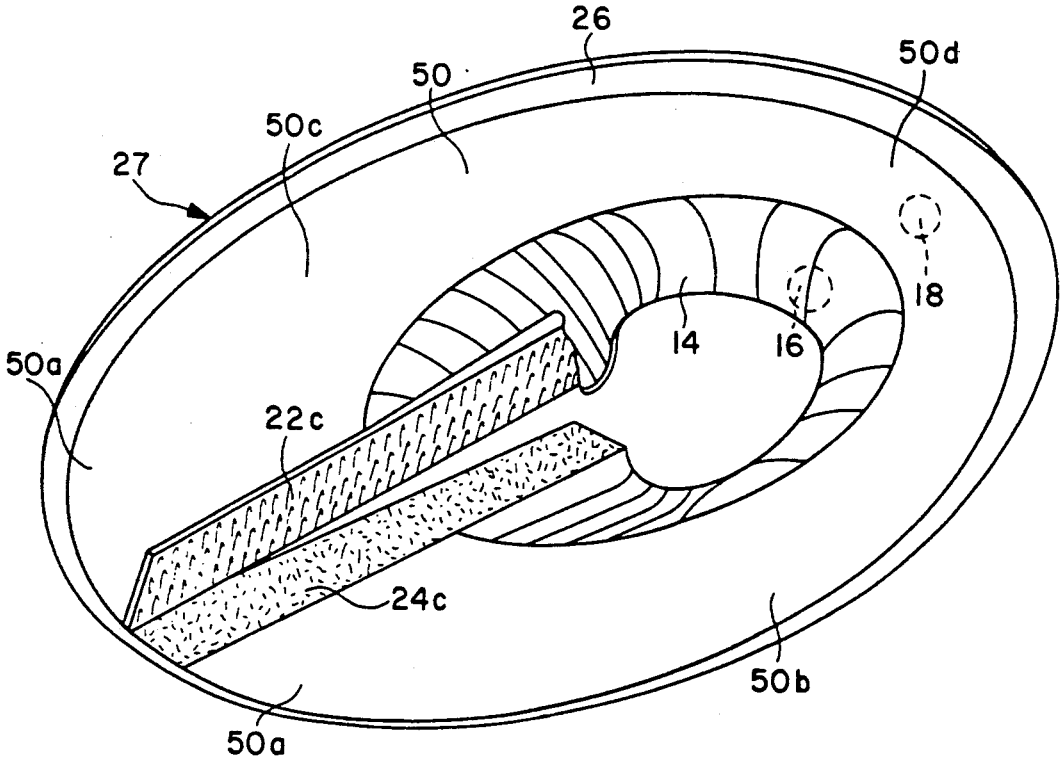
FIG. 3 is a perspective view of the second embodiment of the helmet closure.

Referring to FIG. 3, the second embodiment of the closure includes a continuous, single piece annular band 50 that is moulded or cut and longitudinally slit to have an overlap in the front. The band 50 thus has rear and side panel portions having integrally formed longitudinal edges; and advantageously is of the same longitudinal dimensions as the corresponding portions 10, 20 and 12 of the first embodiment and made of the same material as portions 10. The side panel portions have front latitudinal edge portions. Due to the provision of the slit in the band that is defined by the band longitudinal front terminal edges, the wearer's head can slip through the band and into the helmet. Front slit hook fastener 22*c* and front slit loop fastener 24*c*, which are sewn to the longitudinal front edge portions of the band and the neck ribbing 14 are attachable together to seal the slit. The upper latitudinal edge of the band is sewn to mounting strip 27. The second embodiment may be further modified to be formed by a single piece of material which performs the functions of sheet material 10 and neck ribbing 14, or may be formed of pieces of the same material sewn together.

Figure 2:
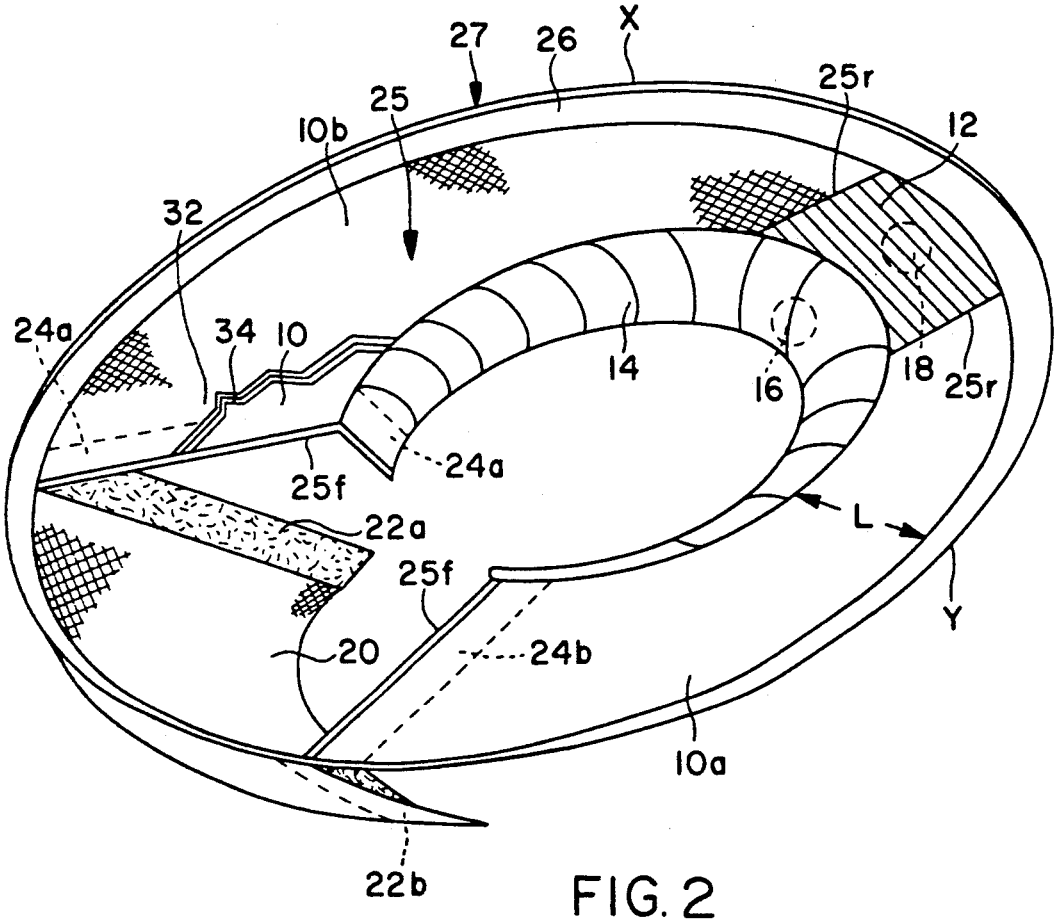
FIG. 2 is a perspective view of the helmet closure of FIG. 1.

OPERATION—FIGS. 1, 2 and 3

The manner of using the preferred embodiment of the helmet closure is illustrated in FIG. 1 and FIG. 2. Use of the closure begins by attaching it to the integral helmet. This is done by first slightly separating the helmet's interior padding 39 from the helmet shell 36. Generally, this padding is fitted into place in the helmet shell without means of attachment other than friction. Thus this separation is generally quick and easy and it is not necessary to destroy any aspect of the shell's interior. Next the fasteners are applied to the shell.

The closure is put into place and perimeter loop fastener strip 28 is attached to perimeter hook fasteners 30*a-f*. Next the padding is pushed back into place. The padding further secures the closure in place by squeezing the strip reinforcement, and sheet material and lining outer (upper) edges between the helmet shell and helmet padding. The closure is now attached to the integral helmet.

The closure wearer then opens front flap 20 by pulling down to separate the hook and loop fastening strips. The helmet is then slipped on in the normal fashion by pulling it over the head. The helmet retention device is secured. Neck ribbing hook and loop fasteners 16 and 18 are separated by pulling the bottom rear of neck ribbing 14. Next, front flap 20 is closed by sealing hook and loop fastening strips 22*a-b* and 24*a-b*. The helmet and closure are now ready for riding. At this time the side panels extend downwardly and horizontal toward the neck while the front flap extends downwardly and under the chin. The front portions of the side edges may extend under parts of the chin while the rear panel is located adjacent to the nape of the neck.

Sheet material 10 and front flap 20 provide the primary surface areas sealing the helmet head opening. Elastic panel 12 allows the rear portion of the closure to stretch while the helmet and closure are being pulled over the head. In pulling on the helmet the wearer's thumbs may abut against opposite inside surfaces of the ribbing 14 to pull the ribbing portions against or adjacent to the respective sides of the helmet while the fingers of the respective hand abut against the adjacent side of the helmet, or holding the helmet chin straps (not shown) which move the adjacent parts of the side panels and the ribbing apart. In either event, this stretching of the ribbing 14 allows easy entry and exit of the helmet head opening. To facilitate this stretching, neck ribbing 14 must also be elasticized. The stretch in neck ribbing 14 also allows it to fit snugly to the different sized necks of individual wearers.

Figure 6:
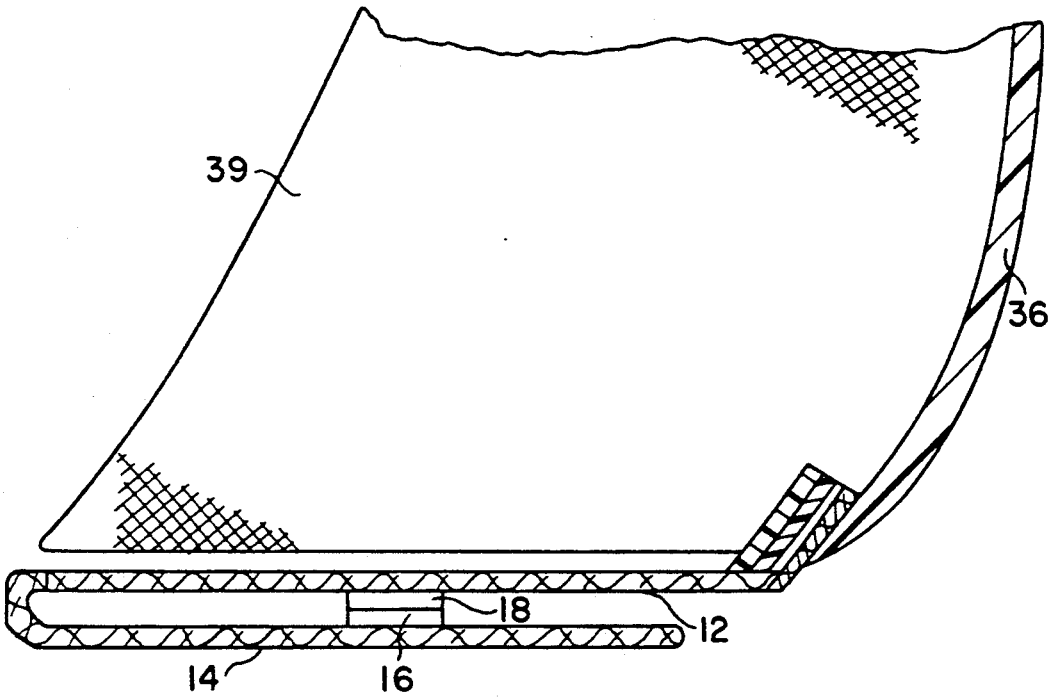
FIG. 6 is a cross sectional view of the first embodiment showing the neck ribbing attached to the rear panel.

When putting on the helmet at least a major longitudinal portion of the side and rear panels are abuttable against the lower edge of the padding, in part shown by FIG. 6, that in conjunction with the above manner of putting on the helmet and the greater rigidity of the panels relative to the ribbing aid together with the elastic panel being of a one way stretchable elastic aid in retaining the closure, other than for the members 26, 28 and 29, exterior of the helmet. When the helmet is on the head the ribbing in combination with the flap 20 extends completely around the neck of the wearer with the front and side panels extending downwardly below the vertically adjacent helmet lower edge portions and toward the neck of the wearer and the neck ribbing, at least for substantially all of the ribbing, is at a lower elevation than the lower edge of the strip members 26, 28 and 29. Preferably the latitudinal and longitudinal dimensions of the front flap 20 are such that during use it will underlie at least a major portion of the chin.

As may be seen from FIG. 2, the combined longitudinal dimension of the top edge of the side panels and back panel is substantially less than the corresponding longitudinal dimension of the bottom edge. When not in use, the latitudinal dimensions of the lower edge of the neck ribbing is less than the upper edge thereof. Further the latitudinal stretchability of the side panels and strip reinforcement 26 is substantially less than that of the back panel while the corresponding stretchability of the back panel is substantially less than the ribbing.

Neck ribbing hook and loop fasteners 16 and 18 automatically attach to each other when the helmet is removed. The purpose of this convenience feature is to aid in preventing the neck ribbing rear portion being forced into the helmet cavity when the helmet is pulled over the wearer's head, the thumbs or chin straps holding opposite side portions apart while the helmet is being pulled over the head.

Front flap 20 and front flap hook and loop fastening strips 22*a-b* and 24*a-b* allow the front of the closure to open broadly thus allowing the head to fit through the closure into the helmet. The front flap is shaped to fit comfortably around the front part of the wearer's neck when closed The hook and loop fasteners allow quick and easy opening and closing, although other fastening means such as zippers or snaps could be used. If hook and loop fasteners are used, advantageously a zipper could be provide in the front flap latitudinally intermediate the longitudinal opposite edges of the front flap 12 and extending almost to the bottom edge of the flap to permit latitudinal separation of longitudinal intermediate portions of the front flap for ventilation purposes while the upper portion of the front flap remains unseparated.

Strip reinforcement 26 adds rigidity to the upper edge of the closure. Also it assists in securing the closure to the helmet when it is squeezed between the helmet padding and helmet shell. Perimeter hook and loop fasteners members 30*a-f* and 28 further secure the closure to the shell 36. Finally, lining 32 gives the closure interior a finished look and provides a soft surface.

The use of the embodiment of FIG. 3 is substantially the same as that of FIG. 1 other than member 50 performs the functions of the side and front panels, the fastener member 18 is attached to the rear portion of band 50 instead of to an elastic panel, and the two fastener members 22*c*, 24*c* perform the retaining function of the fastener members 22*a*, 22*b*, 24*a* and 24*b*.

Figure 4:
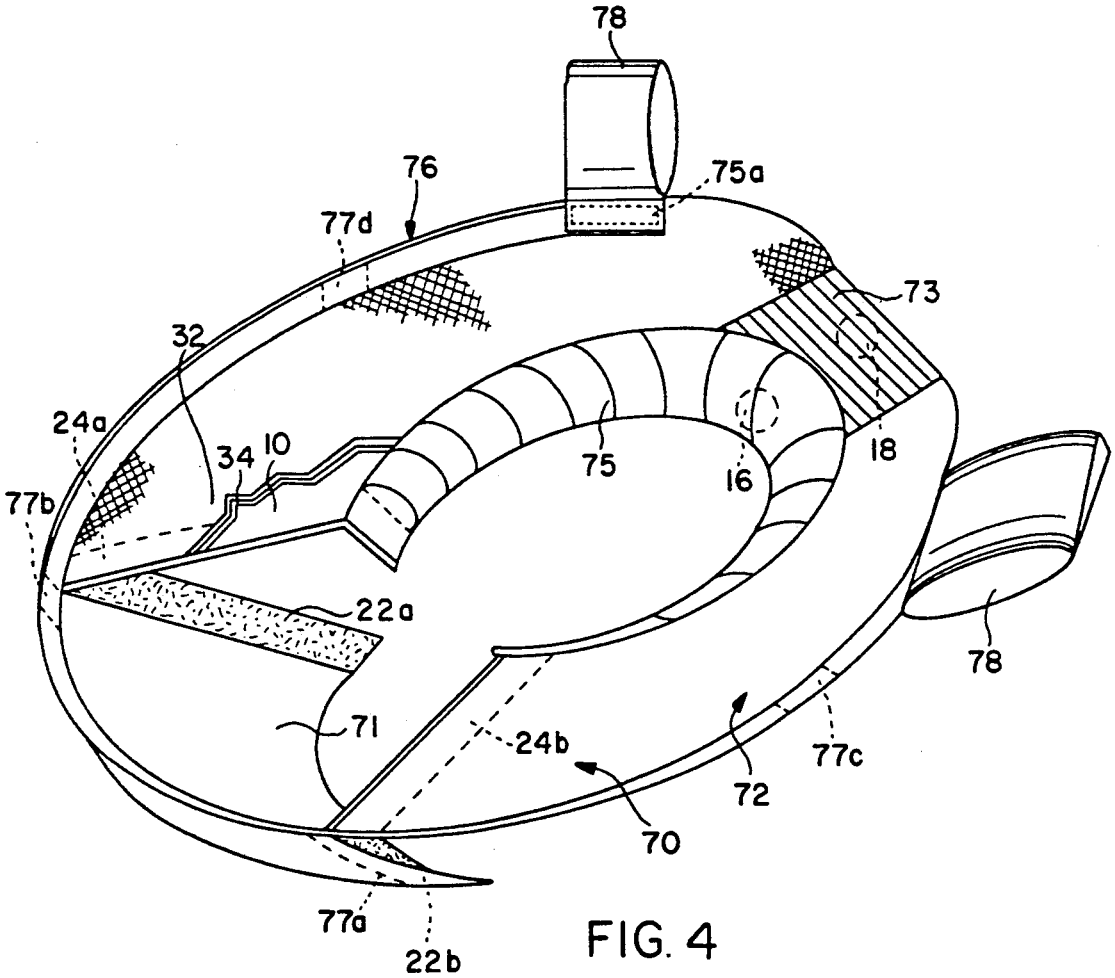
FIG. 4 is a perspective view of the third embodiment of the helmet closure.
Figure 5:
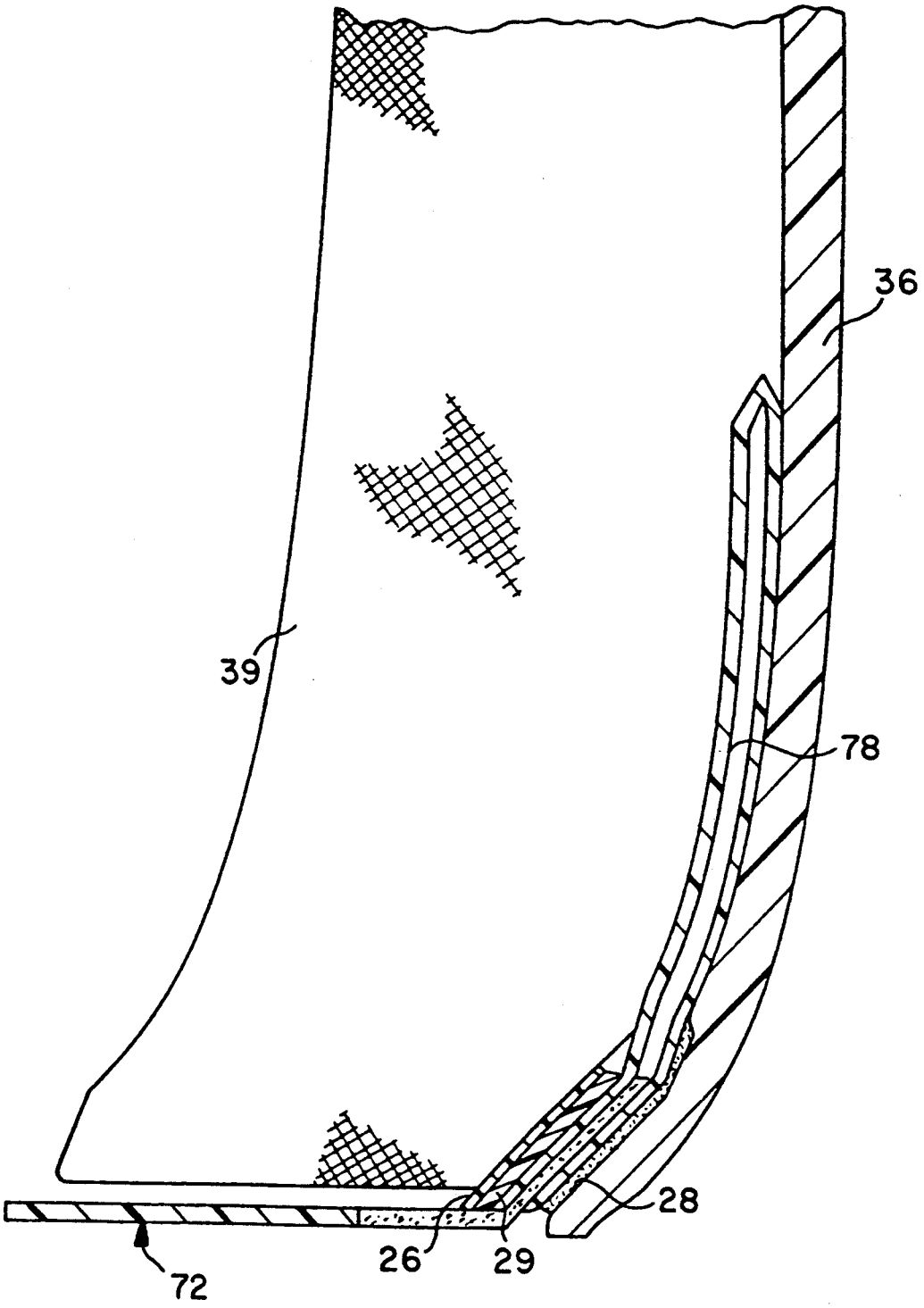
FIG. 5 is a cross sectional view of the helmet and one of the holder straps of the closure of FIG. 4.

There are brands of helmets in which the lower rear edge portion of the padding can not be separated from the adjacent part of the helmet shell without damaging that part of the padding, and according there is provided the third embodiment of the invention, generally designated 70. Referring to FIGS. 4 and 5, the third embodiment of the closure 70 includes a front panel 71, side panels generally designated 72, an elastic panel 73 that advantageously may be the same material as that of the first embodiment, and neck ribbing 75 that are substantially the same as the corresponding members 20, 25, 12 and 14 and joined to one another in substantially the same manner other than for the upper latitudinal edge of the elastic panel and the longitudinal dimension thereof. The third embodiment also includes a mounting strip, generally designated 76, that advantageously is the same material as strip 26, other than for latitudinal (arcuate) length and at its lower edges is sewn to the front panel and the longitudinal adjacent parts of the side panels with the respective side panel being sandwiched between the legs of the respective reversely bent mounting strap 78. The strip 76 also includes arcuately spaced, exterior loop fastener portions 77*a*, 77*b*, 77*c*, 77*d* for forming a removably attachment with fasteners 30*a*-30*d*.

The upper edge portion of the front flap is sewn to the latitudinal midportion of the mounting strip, generally designated 76, while the rear terminal longitudinal edges 76*a* of the strip 76 are rearwardly arcuately spaced from one another by a distance greater than the corresponding dimension of the elastic panel but latitudinally much more closely adjacent to the adjacent longitudinal rear edge of the respective side panel than the front edge of the same panel. The rear arcuate spacing of the longitudinal terminal edges 76*a* of the mounting strip is slightly greater than the corresponding spacing of the lower rear portion of the padding that is fixed to the shell.

To each of the terminal end portions of the mounting strap 76 there is sewn opposite end portions of a reversely bent mounting strap 78. The straps extend upwardly longitudinally away from the mounting strip a distance many times greater, for example at least four times greater, than the corresponding dimension of the mounting strip. The straps are made of a resilient material that is of a greater rigidity than the mounting strips 27, 76 and have a memory whereby the opposite legs of the respective strap are bowed to have their midportions substantially spaced such as indicated in FIG. 5. The arcuate spacing of the adjacent longitudinal edges of the straps is a little greater than the corresponding portions of the rear part of the padding that is fixed to the helmet shell.

In using the third embodiment the mounting strip is pushed between the lower edge portions of the helmet shell and padding that are not fixedly attached to one another and the straps 78 are pushed upwardly between the padding and shell adjacent to the rear part of the padding that is fixed to the shell. The straps when pushed between the padding and shell have their lower terminal edges adjacent to the lower edges of the padding and shell with their legs forced together against their resilient action. As a result the padding and shell in abutting against the straps act to hold the rear portion of the closure in place while the loops on the mounting strip form an attachment connection to the hook fasteners on the shell interior. If desired, the hook fasteners adhered to the shell interior may be one continuous band for engaging the mounting strip forwardly of the straps when the closure is in its position of use.

The embodiment of FIG. 2 may be modified by having the loop fastener strip sewn to the strip reinforcement 26 and member 29 front and side portions such as shown in FIG. 5 to rearwardly terminate at locations X and Y shown in FIG. 2. In such an event the elastic panel and side panels would be longitudinally extended to be exterior of the strip reinforcement and sewn to the upper and lower edges of the strip reinforcement rearwardly between the locations X and Y with the rear longitudinal edges of the side panels being sewn to the adjacent longitudinal terminal edges of the elastic panel. The latitudinal length of a single strap (not shown) would be substantially less than the corresponding dimension of the elastic panel. The single strap which is the same as strap 78 is sewn to the latitudinal midportion of the upper edge portions of the elastic panel and the rear midportion of the strip reinforcement. The single strap serves to hold the rear portion of the closure in place even though no loop fastener is provide latitudinally rearwardly between X and Y. If two straps are used as shown in FIG. 4, the mounting strip may be modified by eliminating the loop fasteners, and if desired, the strip reinforcement reversely bent over the expansion strip, if used; and hook fasteners may be eliminated from the helmet shell.

Figure 9:
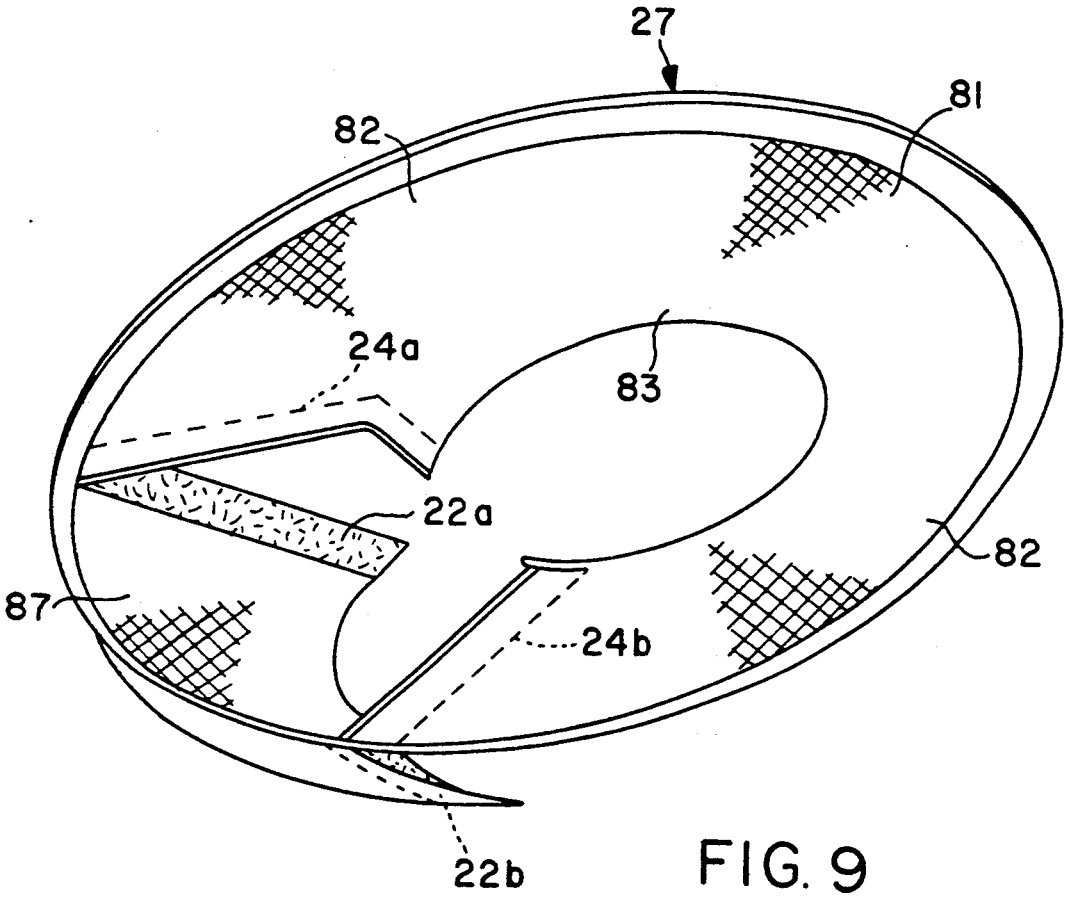
FIG. 9 is a perspective view of the fourth embodiment of the helmet closure.

Referring to FIG. 9 the fourth embodiment is same as the second embodiment other than the rear panel portion 81 at its opposite longitudinal edges is integrally joined to the adjacent longitudinal edge portions of the side panel portions 82 and the lower neck closure portion 83 has its upper latitudinal edge portion is integrally joined to the lower latitudinal edge of the side and rear panel portions. Thus the portions 81, 82, 82, 83 may be separate portions sewn together and of about the same size and shape in plan view as the corresponding parts 12, 10, 10, 14 of the first embodiment, or may be made of a single integrally formed piece of material with lower latitudinal edge being about the same or slightly larger than the lower terminal edge of the neck ribbing fabric. Advantageously portions 81, 82, 83 are made of a material the same as that of the parts 12, 10, 10, 34, or more advantageous nylon laminated neoprene sheet material that is of about the same rigidity and stretchability as part 10.

The upper latitudinal edge of portions 81, 82, 82, 83 are sewn to mounting strip 27 in the same manner as that described with reference to the first embodiment. If desired, lining and sound absorbing material of materials the same as that of material 32, 34 respectively may be sewn to the sheet material of portions 81, 82, 82, 83.

A front flap 87 and fasteners 22*a*, 22*b* that are of the same material and size and shape as the front flap and fasteners 22*a*, 22*b* of the first embodiment has its upper latitudinal edge sewn to the mounting strip 27 of the fourth embodiment. Further fastener members 24*a*, 24*b* are sewn to the latitudinal front edge portions of the side panel portions 82, 82 to removable attach the front flap to the side panel portions in the same manner that the front flap of the fourth embodiment is removable attached to the fastener members 24*a*, 24*b* of the first embodiment throughout their longitudinal lengths.

Fastener members 16, 18 may be sewn to the rear panel portion 81 at the same relative locations as the corresponding members are sewn to ribbing 14 and the panel 12 of the first embodiment. The lower peripheral edge of the sealing portion 83 advantageously is of the same size as that of the corresponding edge of fabric 14 when not in use, or somewhat greater, it being noted that the fabric 14 is of a greater stretchability than portion 83.

In place of the loop and hook fasteners, there may be provided a plastic clip (not shown) of a latitudinal length to extend between the helmet shell lower edge portion and the lower edge portion of the padding that is not fixedly attached to the helmet shell. At least the lower part of the clip is generally C or U shaped to have the helmet shell extend between the legs of the clip for providing a resilient clipping attachment to the helmet when the inner leg extends between the shell and padding. In such an event the upper edges of at least the front flap and side panels would be fixedly attached to the inner leg of the clip.

Each of the mounting strips is of sufficient rigidity (self sustaining) that when its lower edge is on a horizontal supporting surface, the upper edge remains substantially vertical above the lower edge by the longitudinal dimension of the mounting strip while being of sufficient flexibility to slide in between the helmet shell and the adjacent part of the padding that is not fixed to the shell. As may be noted from the drawings the longitudinal dimension of the mounting strip is many times small than the minimum longitudinal dimension of the side and rear panels of the closure. However the side panels are not of sufficient rigidity to be self supporting in the manner such as above mentioned for the mounting strip.

With reference to each of the embodiments, the front panel portion (flap 20, 71, 87 and 50*a*, 50*a*) of the closure in use is of a latitudinal dimensions to underlie the chin and a longitudinal dimension to extend downwardly from adjacent to the lips of the wearer and downwardly and inwardly to closely adjacent to the neck area that extends directly below the chin. With reference to the FIG. 3 embodiment, the sheet material of band 50, and the lining and sound absorbing thereof, if provided, has a rear panel portion 50*d*, opposite side panel portions 50*b*, 50*c* and front parts 50*a*, 50*a* defining a front panel portion when attached to one another during use that advantageously are about of the same size and shape as the corresponding panels portions 12, side panel portions 10*a*, 10*b* and 20 respectively.

In order to decrease the cost of manufacture, the lining 32 and the layer 32 may be eliminated in each one of the embodiments.

SUMMARY, RAMIFICATIONS AND SCOPE

Thus the reader will see that the helmet closure provides a simple means of sealing the head opening of most integral helmets. The closure provides several advantages including:

(a) it reduces wind noise and turbulence thus increasing wearer comfort, enjoyment and safety;

(b) it seals out bugs, road debris, sand, dust, rain, and snow:

(c) it reduces helmet lift:

(d) it enhances adjustable ventilation control;

(e) it keeps the head and neck warmer in cold weather riding thus enhancing rider comfort, enjoyment and safety;

(f) it enhances the ability to hear helmet stability; and (g) it can be made to fit most integral helmets.

Although the description above contains many specificities, these should not be construed as limiting the scope of the invention, but as merely providing illustrations of some of the presently preferred embodiments of this invention. For example, the helmet closure would enhance helmets used in snowmobiling, auto, boat and other motor vehicle racing, three and four wheel recreational vehicle driving, skiing and other such activities. Also, the neck ribbing can be shortened or lengthened to cover more or less the neck. A neck wind band can be used in conjunction with the closure to completely cover and seal the neck area. Different colors can be used to match the helmet. Different shapes can be used to fit most integral helmets. The closure can be made to attach to the outside of the helmet shell rather than between the helmet shell and helmet padding.

Thus, the scope of the invention should be determined by the appended claims and their legal equivalents, rather than by the example given.

What is claimed is:

1. A helmet closure for use with an integral helmet that has a helmet shell having a lower peripheral edge portion and padding within the shell, the padding having a lower edge portion, the helmet closure comprising opposite side panel portions that each has front and rear longitudinal edges, a rear panel portion having opposite longitudinal ledges joined to the adjacent side panel portion rear edge, each of the side and rear panel portions having latitudinal upper and lower edges, closure means for removably joining the side panel portion front edges to one another to, in conjunction with the panel portions, encircle an adults neck, mounting strip means joined to the upper edges of the panel portions for removably cooperating with the helmet to removably attach the panel portions to the helmet, the side portions in at least a latitudinal direction being of a greater rigidity than that of the rear panel portion and the mounting strip means in at least a latitudinal direction being of a greater rigidity than each of the side panel portions, and stretchable neck sealing means for surrounding at least a major portion of the neck of the wearer of he helmet, the neck sealing means having an upper edge joined to the lower edges of the panel portions.

2. The helmet closure of claim 1 wherein the closure means comprises a front flap having a first longitudinal edge portion and a second longitudinal edge portion substantially latitudinally spaced from the flap first longitudinal edge portion and an upper latitudinal edge portion sewn to the mounting strip means, fastener means on the flap first longitudinal edge portion and one of the side panel portions for removably securing the flap first longitudinal edge portion to the said one of the side panel portions, and second fasteners means on the flap second longitudinal edge portion and the other side panel portion for removably securing the flap second longitudinal edge portion to the said other of the side panel portions.

3. The helmet closure of claim 1 wherein the mounting strip means includes a latitudinally elongated peripheral reinforcing strip having a front portion and opposite side portions, and at least a first longitudinally upwardly extending strap means joined to the reinforcing strip remote from the strip reinforcing front portion for insertion between the helmet shell and the padding.

4. The helmet closure of claim 3 wherein the reinforcing strip has latitudinally free terminal rear first and second end portions and the mounting strip means has a second longitudinally upwardly extending strap joined to the first strip reinforcing end portion for insertion between the helmet shell and the padding, the first strap being joined to the second strip reinforcing end portion.

5. The helmet closure of claim 1 wherein the mounting strip means comprises a latitudinal mounting strip for completely encircling the wearer's head and that the rear panel portion is made of an elastic material.

6. The helmet closure of claim 5 wherein the rear panel portion elastic material is of a one way stretchable elastic and being stretchable in a latitudinal direction.

7. The helmet closure of claim 5 wherein the neck sealing means comprises elasticized ribbing fabric having latitudinal upper edge portions sewn to the side panel portions and the rear panel portion, the rear panel being of a greater latitudinal and longitudinal rigidity than the ribbing fabric.

8. The helmet closure of claim 1 wherein the neck sealing means is made of ribbing fabric, the ribbing fabric and the rear panel portion having longitudinally intermediate portions, and that there is provided hook and loop fastening material means sewn to the rear panel portion and the neck means for releasably retaining the rear panel portion and the ribbing fabric longitudinally intermediate portions in relative positions for facilitating an extending of the wearer's head through the closure.

9. The helmet closure of claim 8 wherein each side panel comprises an exterior layer of wind resistant material, an intermediate layer of sound damping material, and an inner layer of soft, stretchable material.

10. The helmet closure of claim 8 wherein the mounting strip means comprises a latitudinally elongated strip reinforcement, and an latitudinally elongated mounting strip having a plurality of longitudinal slits extending partially longitudinally therethrough, and a fastener strip sewn to the strip reinforcement and mounting strip with the mounting strip sandwiched between the fastener strip and the strip reinforcement to facilitate removably fastening the mounting strip means to the helmet.

11. The helmet closure of claim 8 wherein the side panel portions have latitudinal front end portions extending downwardly and inwardly toward the wearer's neck and that the closure means comprises a front flap for extending beneath the wearer's chin, the flap having an upper latitudinal edge joined to the mounting strip means and latitudinally opposite, substantially spaced longitudinal edges, and cooperating fastener means joined to the flap longitudinal edges and the side panel front edge portions for removably securing the side panel front edge portions to the flap longitudinal edges to permit movement of the front flap to facilitate the wearer extending the wearer's head through the closure.

12. A helmet closure for use with an integral helmet that has a helmet shell having a lower peripheral edge portion and padding within the shell, the padding having a lower edge portion, the helmet closure comprising opposite side and rear panel portions for encircling at least the side and rear portions of the wearer's neck, each of the side and rear panel portions having latitudinal upper and lower edges portions, the side panel portions having front longitudinal edge portions for extending downwardly and inwardly toward the wearer's neck, front closure means for removably joining the side panel portions front edges to one another to, in conjunction with the panel portions, encircle the wearer's neck and have the front closure means and the side panel portions front edge portions extend downwardly and inwardly toward the wearer's neck and under the wearer's chin, and mounting strip means fixedly joined to the upper edges of the panel portions for extending between the shell and padding and removably cooperating with the helmet to removably attach the panel portions to the helmet, at least the side panel portions being of a flexible, stretchable, wind resistant sheet material, and stretchable neck ribbing fabric material having an upper latitudinal edge joined to the panel portions lower edge portions and to the closure means to, in conjunction with the closure means, encircle the wearer's neck.

13. The helmet closure of claim 12 wherein the side panel portions each has a front latitudinal edge portion that includes one of the front longitudinal edges, the closure means includes a first longitudinal extending fastener member fixedly joined to one of the side panel front longitudinal edge portions and a second fastener member fixedly joined to the other side panel front longitudinal edge portion for cooperating with the first fastener member to removably attach the side panel front longitudinal edge portions to one another.

14. The helmet closure of claim 12 wherein the neck ribbing fabric material comprises stretchable neck sealing means for surrounding at least a major portion of the neck of the wearer of the helmet, the neck sealing means having an upper latitudinal edge joined along at least substantially the entire length of the lower latitudinal edges of the side and rear panel portions and a lower free latitudinal edge that is substantially shorter than the dimension of the upper latitudinal edge of the neck sealing means.

15. The helmet closure of claim 12 wherein each of the side panel portions front longitudinal edge is closely adjacent to the other to form a single slit and that the closure means comprises cooperating fastening means on the side panel portions front longitudinal edges for removably attaching the front longitudinal edge portions to one another.

16. A helmet closure for use with an integral helmet having a helmet shell, the closure comprising a sheet of flexible, stretchable, wind resistant material of the approximate size of an integral helmet head opening and having a hole in the approximate center about the size and shape of a human adult's neck, the sheet material having an upper latitudinal edge, a lower latitudinal edge and latitudinally opposite front longitudinal side edge portions spaced to form a gap, affixing means for attaching said closure to the helmet shell, opening/closing means for use in combination with the sheet material to allow a human head to pass through said closure into and out of the integral helmet and for sealing the head inside the helmet and the closure, the opening/closing means including a front flap having spaced edge portions, the front flap being shaped such that the front flap edge portions overlap the sheet material longitudinal side edge portions on each latitudinal side, the front flap closing onto the sheet material longitudinal side edge portions and being openable and closable, and fastener means secured to each sheet material longitudinal side edge and flap edge portion respectively to oppose each other for removably attaching the sheet material longitudinal side edge portions to the front flap edge portions.

17. A helmet of claim 16 wherein the sheet material longitudinal side edge portions adjacent to the upper latitudinal edge are spaced by approximately 6 cm and the sheet material longitudinal side edge portions adjacent to the lower latitudinal edge portions are spaced by approximately 9 cm, the front flap edge portions overlap the sheet material longitudinal side edge portions about 2 cm on each latitudinal side, and the fastener means comprises hook and loop fastening strips sewn to each sheet material longitudinal side edge and flap edge portions respectively to oppose each other.

18. A helmet of claim 16 wherein the sheet material is of single integrally formed continuous piece and has a lower terminal latitudinal end portion that, in conjunction with the flap, forms a sealing means for closing the lower end portion of the closure and completely encircling the neck.

19. A helmet of claim 16 wherein the sheet material comprises opposite first and second panel portions having latitudinally spaced, longitudinal rear first and second terminal edges and an elastic panel having latitudinally opposite first and second longitudinal edges joined to the adjacent rear terminal first and second longitudinal edge respectively.

20. A helmet closure for use with an integral helmet and having a bottom portion, the helmet closure comprising a sheet of flexible, stretchable, wind resistant material of the approximate size of an integral helmet head opening and having a hole in the approximate center about the size and shape of a human adult's neck, affixing means for attaching said closure to a helmet shell, the affixing means being joined to the sheet material, opening/closing means joined to the sheet material for allowing a human head to pass through said closure into and out of the integral helmet and for sealing the head inside the helmet and the closure, sealing means joined to the sheet material to in conjunction therewith close the bottom portion of the closure around a wearer's neck and fastening means for cooperating with the sealing means for preventing the sealing means tucking into the helmet when the helmet is pushed over the wearer's head, the sealing means comprising ribbing fabric, the sheet material and the ribbing fabric having exterior rear center surface portions, the fastening means including hook and loop fastening material sewn in a position to oppose each other on the exterior rear center surface portion of the sheet material and on the exterior rear center surface portion of the ribbing material.

21. A helmet closure for use with an integral helmet that has a helmet shell having a lower peripheral edge portion and padding within the shell, the padding having a lower edge portion, the helmet closure comprising opposite side and rear panel portions for encircling at least the side and rear portions of the wearer's neck, each of the side and rear panel portions having latitudinal upper and lower edges portions, the side panel portions having front longitudinal edge portions, closure means for removably joining the side panel portions front longitudinal edges to one another to, in conjunction with the panel portions, encircle at least the front and side portions of the wearer's neck, and mounting strip means joined to the upper latitudinal edges of the panel portions for removably cooperating with the helmet to removably attach the panel portions to the helmet, at least the side panel portions being of a flexible, stretchable, wind resistant sheet material, and stretchable neck ribbing fabric material having an upper latitudinal edge joined to the panel portions lower latitudinal edge portions and to the closure means to, in conjunction with the closure means, encircle the wearer's neck, the rear panel being of an elastic material.

22. A helmet closure for use with an integral helmet that has a helmet shell having a lower peripheral edge portion and padding within the shell, the padding having a lower edge portion, the helmet closure comprising opposite side and rear panel portions for encircling at least the side and rear portions of the wearer's neck, each of the side and rear panel portions having latitudinal upper and lower edges portions, the side panel portions having front longitudinal edge portions, closure means for removably joining the side panel portions front longitudinal edges to one another to, in conjunction with the panel portions, encircle at least the front and side portions of the wearer's neck, and mounting strip means joined to the upper latitudinal edges of the panel portions for removably cooperating with the helmet to removably attach the panel portions to the helmet, at least the side panel portions being of a flexible, stretchable, wind resistant sheet material, and stretchable neck ribbing fabric material having an upper latitudinal edge joined to the panel portions lower latitudinal edge portions and to the closure means to, in conjunction with the closure means, encircle the wearer's neck, the side panel portions having front latitudinal edge portions that each has one of the front longitudinal edges, the closure means including a first longitudinal extending fastener member fixedly joined to one of the side panel front longitudinal edge portions, a second fastener member fixedly joined to the other side panel portion and a front flap having substantially latitudinally spaced longitudinal edge portions that each has a fastener member joined thereto for cooperating with the adjacent one of the first fastener member and second fastener member for removably attaching the flap longitudinal edge portions to the side panel front longitudinal portions.

* * * * *